United States Patent [19]

Bailey

[11] 4,368,831

[45] Jan. 18, 1983

[54] BEER KEG TAPPING ASSEMBLY

[75] Inventor: Victor S. Bailey, Teddington, England

[73] Assignee: Grundy (Teddington) Limited, Middlesex, England

[21] Appl. No.: 120,789

[22] Filed: Feb. 12, 1980

[51] Int. Cl.[3] ..... B65D 83/00; B67D 1/04

[52] U.S. Cl. ..... 222/400.7; 137/212

[58] Field of Search ..... 222/400.7, 400.8; 137/212

[56] References Cited

U.S. PATENT DOCUMENTS

| | | | |
|---|---|---|---|
| 2,157,966 | 5/1939 | Reisinger et al. | 222/400.7 |
| 3,036,586 | 5/1962 | Reeve | 222/400.7 X |
| 4,180,189 | 12/1979 | Zurit et al. | 137/212 |

FOREIGN PATENT DOCUMENTS

| | | | |
|---|---|---|---|
| 2123347 | 12/1971 | Fed. Rep. of Germany | 137/212 |
| 7704708 | 10/1978 | Netherlands | 222/400.7 |
| 7806760 | 12/1979 | Netherlands | 222/400.7 |
| 1423796 | 2/1976 | United Kingdom | 137/212 |

*Primary Examiner*—David A. Scherbel

*Attorney, Agent, or Firm*—Emory L. Groff, Jr.

[57] ABSTRACT

A cask or container for liquid under pressure having a housing welded to the cask wall around the bung hole, this housing serving as the sole support for a spring loaded ring seal and an extractor tube and its head the latter concentric within the seal.

3 Claims, 1 Drawing Figure

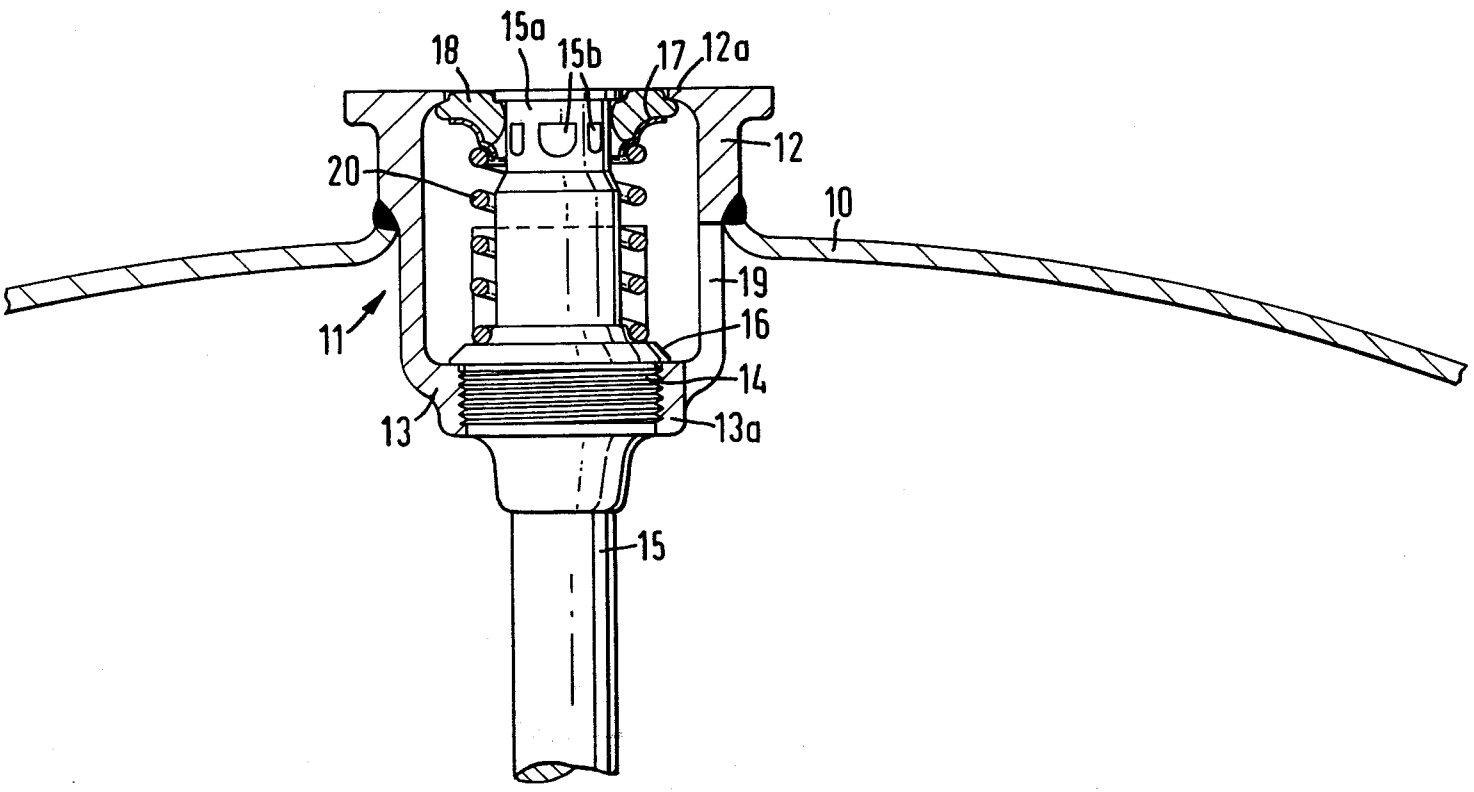
10
12
12a
17
15b
15a
18
20
11
19
16
14
13a
13
15

BEER KEG TAPPING ASSEMBLY

FIELD OF THE INVENTION

This invention relates to a cask or container for liquid under pressure, and is of the type in which the bung hole has a spring loaded ring seal within a collar around the bung hole, there being an extractor tube extending downwardly to near the bottom of the container this tube having a head the top of which is substantially co-planar with the top surface of the ring seal and located therein so that before broaching the seal forms a closure between a seating of the collar and head, the cask being broached by securing a dispensing head on to the collar, and moving a plunger in the dispensing head to depress the seal, this action also putting an outlet from the extractor head in communication with a liquid outlet through the dispenser head, and applying also through the head, gas under pressure on to the surface of the liquid to dispense same.

BRIEF DESCRIPTION OF PRIOR ART

With casks as above it is customary to secure a collar to the top wall of the cask so as to upstand around the bung hole in which collar a metal insert engages this insert being internally screw threaded to receive a closure fitting which fitting carries the ring seal and extractor tube.

OBJECTS OF THE INVENTION

Objects of this invention are to provide a simplified construction for mounting the seal and tube and in which no metal insert is used, and which results in a preferred construction which is substantially tamper proof in that it is difficult without a special tool, to remove the extractor tube.

SUMMARY OF THE INVENTION

According to this invention there is provided a cask or like container for pressurised liquid, wherein a housing is secured to the top wall of the cask at the bung hole outlet to upstand therearound said housing having a skirt portion depending into the cask said skirt having an inturned flange at its lower end in which a bush or sleeve engages the extractor tube passing through the bush or sleeve to which it is secured, the extractor tube head being located within the housing above the bush, the ring seal and loading spring also being located in the housing around the head, so that the periphery of the seal engages a seating within and at the upper end of the housing, and the top of the head is received in the ring seal.

Preferably the bush engages in the skirt flange by screw threads and the bush and extractor tube are integral.

With the above arrangement, the use of a liner is dispensed with. Also, the extractor tube can be removed only by upsetting the sealing ring to remove same, and then removing the extractor tube which calls for the use of a special tool to engage the head.

BRIEF DESCRIPTION OF THE DRAWING

The accompanying drawing illustrates a preferred embodiment in section.

DESCRIPTION OF PREFERRED EMBODIMENT

As shown, the top wall 10 of the container has a bung hole 11 and a housing 12 is secured around the hole by welding. The housing has a skirt portion 13 with an inturned flange 13*a*. A bush 14 engages in the flange by screw threads and the extractor tube 15 is secured to the bush or preferably moulded thereto, the bush and tube being of synthetic plastic material.

A collar 16 seats on the upper surface of the flange 13*a* and a compression spring 20 extends between this collar and a cup seat 17 for a ring seal 18, so that unless the cask has been broached the seal engages by its periphery a seating 12*a* and the undercut top of the extractor tube head 15*a* of the tube 15.

The skirt is gapped, e.g. at 19, to allow gas under pressure to enter the cask after the dispenser head has been fitted and the cask broached this also depressing the ring seal against its spring loading.

If it is desired to remove the extractor tube, then the seal is upset and removed and the tube, head, and bush unscrewed. A special tool is required for this operation e.g. one to engage in the liquid outlet apertures 15*b* of the head.

I claim:

1. A cask for pressurised liquid said cask having a housing integrally secured to the top wall of the cask at a bung hole outlet to upstand therearound, said housing comprising an integral skirt depending into the cask and an integral body upstanding from the cask, said body having a flange forming a coupling member to engage a liquid dispensing head, said skirt having an inturned flange at its lower end, a liquid extractor tube extending from the bottom of the cask up into the housing, a bush secured to said extractor tube and connecting said tube to said inturned flange, the diameter of the bush around the extractor tube being of less diameter than the diameter of an aperture in the upper end of said body of the housing thereby enabling the extractor tube to be withdrawn through said body, said extractor tube including a head portion located with said housing above said bush, a ring seal and loading spring located in said housing and positioned around said extractor tube, a seat within and located around the aperture in the upper end of the body of said housing, a peripheral part of said seal engaging said seat, the top end of said extractor tube head being embraced by said ring seal, said spring urging said ring seal into engagement with the seat.

2. A cask as claimed in claim 1, wherein the bush and the liquid extractor tube are formed as an integral structure.

3. A cask as claimed in claim 1, wherein the bush includes a collar to seat against the upper surface of the in turned flange, a compression spring extending between said collar and an annular cup located beneath the seal, the periphery of said seal being thus spring urged against the seating at the upper end of the housing.

* * * * *